United States Patent [19]

Yoshida et al.

[11] 3,961,991

[45] June 8, 1976

[54] METHOD FOR CHEMICAL TREATMENT OF THE SURFACE OF AN IRON SUBSTRATE WITH PHOSPHORIC ACID SOLUTIONS

[75] Inventors: Yuichi Yoshida, Ageo; Akio Takagi, Yokohama, both of Japan

[73] Assignee: Nippon Paint Co., Ltd., Osaka, Japan

[22] Filed: Nov. 21, 1973

[21] Appl. No.: 417,759

[30] Foreign Application Priority Data

Nov. 22, 1972 Japan ..... 47-117378

[52] U.S. Cl. ..... 148/6.15 R; 106/14

[51] Int. Cl.[2] ..... C23F 7/10

[58] Field of Search ..... 148/6.15 R; 106/14

[56] References Cited

UNITED STATES PATENTS

| | | | |
|---|---|---|---|
| 2,490,062 | 12/1949 | Jernstedt | 148/6.15 R |
| 3,460,989 | 8/1969 | Rusch | 148/6.15 R |
| 3,493,440 | 2/1970 | Ashdown | 148/6.15 R |
| 3,615,912 | 10/1971 | DiHel et al. | 148/6.15 R |

*Primary Examiner*—Ralph S. Kendall
*Assistant Examiner*—John D. Smith
*Attorney, Agent, or Firm*—Wenderoth, Lind & Ponack

[57] ABSTRACT

A method for chemical treatment of the surface of an iron substrate which comprises (a) treating the surface with an aqueous solution containing phosphoric acid in a concentration of 0.5 to 80 weight/volume %, (b) subjecting the surface without water rinsing to treatment with an aqueous solution containing phosphoric acid with a substance capable of reacting with the phosphoric acid to give a water-soluble salt, which is hydrolyzed and/or reacted with the iron substrate to form a volatile base, and/or a substance capable of reacting with the phosphoric acid to give a water-soluble salt, which is hydrolyzed and/or reacted with the iron substrate to form a non-volatile base, the pH of the aqueous solution being 1 to 9, the total ion concentration being 0.2 to 8 weight/volume % and the concentration of the cation from the latter substance being not more than 0.5 weight/volume %, and (c) drying the surface without water rinsing.

14 Claims, No Drawings

METHOD FOR CHEMICAL TREATMENT OF THE SURFACE OF AN IRON SUBSTRATE WITH PHOSPHORIC ACID SOLUTIONS

The present invention relates to a method for chemical treament of the surface of an iron substrate. More particularly, it relates to an industrially advantageous method for chemical treatment of the surface of an iron substrate in fewer steps with the omission of water rinsing.

The chemical treatment of the surface of an iron substrate has been usually carried out in the following order: (1) pretreatment (acid cleaning), (2) water rinsing, (3) after treatment (neutralizing), (4) water rinsing and (5) drying. After the chemical treatment as above, a paint composition is ordinarily applied on the resulting surface. The treatment of the surface of a large iron structure, such as the hull of ship or a block of bridge, according to such conventional method meets various problems. For instance, the quick transference of the structure, the rapid elimination of the treating solution attached and remained on the surface and the prompt drying of the wet surface are necessary. Due to the great largeness size of the surface treated, however, these steps are apparently difficult, and the treatment takes a long time so that rusting occurs and the immediate application of a paint composition thereto is made impossible. Further, a large area is required for treatment in each step, and a large investment therefor is necessary. Moreover, in the water rinsing step, a great amount of fresh water is necessary to maintain a low concentration of the contaminants in the rinse water, which contaminants are carried over from the treating solution in the foregoing step. In addition, a large scale of apparatus is needed for the treatment of a great amount of waste water.

In order to overcome these problems, the omission of the water rinsing step has been highly desired. When, however, the water rinsing between the pretreatment and the after treatment (which is hereinafter referred to as "intermediary water rinsing") is omitted, the treating solution in the after treatment is considerably contaminated with the treating solution of the pretreatment, whereby the effects of the former, such as neutralization, rust prevention and surface conditioning of the surface for painting, are decreased. On the other hand, the omission of the water rinsing between the after treatment and the drying (which is hereinafter referred to as "final water rinsing") results in part of the treating solution remaining in the after treatment and/or the treating solution in the pretreatment being contaminated therein, whereby the corrosion resistance and the adhesiveness of the coating film formed by the application of a paint composition thereto may be unfavorably deteriorated. For avoiding these disadvantages, the modifications of the treating solutions in the pretreatment and the after treatment become necessary.

As the result of extensive studies, it has now been found that the pretreatment with an aqueous solution containing phosphoric acid and the after treatment with an aqueous solution containing phosphoric acid with a substance capable of reacting with phosphoric acid to give a water-soluble salt, which is hydrolyzed and/or reacted with an iron substrate to form a volatile base, and/or a substance capable of reacting with phosphoric acid to give a water-soluble salt, which is hydrolyzed and/or reacted with an iron substrate to form a non-volatile base, make it possible to omit the intermediary water rinsing and the final water rinsing in the said conventional method without producing any unfavorable influence on both of the substrate and the coating film later formed thereon.

Accordingly, a basic object of the present invention is to provide a method for the chemical treatment of the surface of an iron substrate, particularly of a large iron structure, in fewer steps without producing any defects. Another object of this invention is to provide a method for chemical treatment of the surface of an iron substrate, particularly of a large iron structure, without any water rinsing step. A further object of the invention is to provide treating solutions to be used respectively in the pretreatment step and the after treatment step, which makes it possible to omit the water rinsing steps. These and other objects of the invention will be apparent to those skilled in the art to which the invention pertains from the foregoing and subsequent descriptions.

According to the present invention, there is provided a method for chemical treatment of the surface of an iron substrate which comprises (a) treating the surface with an aqueous solution containing phosphoric acid in a concentration of 0.5 to 80 weight/volume percent, (b) subjecting the surface without water rinsing to treatment with an aqueous solution containing phosphoric acid with a substance capable of reacting with the phosphoric acid to give a water-soluble salt, which is hydrolyzed or reacted with the iron substrate to form a volatile base (which is hereinafter referred to as "substance (A)"), and/or a substance capable of reacting with the phosphoric acid to give a water-soluble salt, which is hydrolyzed or reacted with the iron substrate to form a non-volatile base (which is hereinafter referred to as "substance (B)"), the pH of the aqueous solution being pH 1 to 9, the total ion concentration being 0.2 to 8 weight/volume %, and the concentration of the cation forming the substance (B), if any, being not more than 0.5 weight/volume %, and (c) drying the surface without water rinsing.

In the step (a), there is used an aqueous solution containing phosphoric acid in a concentration of 0.5 to 80 weight/volume % (which is hereinafter referred to as "pretreatment solution").

The pretreatment solution is necessary for removal of rusts on the surface to be treated and prevention of rusting until the treatment in the step (b) is made. In order to attain the same purpose as above, there have been also employed hydrochloric acid, sulfuric acid, sulfamic acid and the like. In the method of this invention, however, only phosphoric acid is used, because it is capable of forming a rust proof layer of iron phosphate on the surface of the iron substrate and, even when contaminated into the treating solution in the step (b), can be reacted with the substance (A) to form a useful substance. As the phosphoric acid, there may be employed not only orthophosphoric acid but also any condensed phosphoric acid such as pyrophosphoric acid or tripolyphosphoric acid. In other words, the term "phosphoric acid" herein used is intended to mean the one wherein the $H_2O/P_2O_5$ ratio is larger than 0 and not more than 3. The concentration of the phosphoric acid in the pretreatment solution may be appropriately decided, depending on the amount of the rusts to be removed and is usually from 0.5 to 80 weight/volume percent, preferably from 7 to 30 weight- /volume percent. In case the concentration is less than 0.5 weight/volume percent, a large amount of precipitates is unfavorably formed in the pretreatment solution. In case of the concentration is more than 80 weight/volume percent, the "drag out" of the phosphoric acid into the treating solution in the step (b) becomes too much, and it is uneconomical.

The pretreatment solution preferably contains an acid pickling inhibitor in addition to phosphoric acid. The acid pickling inhibitor functions not only for preventing the excessive dissolution of the iron substrate and the waste consumption of the phosphoric acid, but also for preventing the formation of a white powdery layer of iron phosphate resulting from the excessive reaction between the iron substrate and the phosphoric acid remaining on the surface when the iron substrate after the treatment in the step (a) is allowed to stand for a long period of time without subjecting to the subsequent treatment in the step (b). Examples of the acid pickling inhibitor include any conventional one such as an organic one (e.g. primary amines, secondary amines, tertiary amines, quaternary ammonium compounds, thiourea compounds) or an inorganic one (e.g. stannous compounds, arsenic compounds). One or more of these acid pickling inhibitors may be employed in a concentration of 0.001 to 1 weight/volume percent which can realize at least a 50 percent inhibitory efficiency of the acid pickling. When the inhibitory efficiency is less than 50 %, the preventive effect of forming said white powdery layer is insufficient. In case the concentration is over 1 weight/volume percent, a thick adsorptive layer of the acid pickling inhibitor is formed on the surface of the iron substrate so that the reaction of the treating solution in the subsequent step (b) with the iron substrate is prevented and the corrosion resistance and the adhesiveness of the coating film formed later with a paint composition may be reduced.

In the step (b), there is used an aqueous solution containing phosphoric acid with the substance (A) and/or the substance (B) as the essential components (which is hereinafter referred to as "after treatment solution").

The phosphoric acid to be used for the step (b) may be the substantially same one as for the step (a). In other words, the term "phosphoric acid" may be construed to mean one wherein the $H_2O/P_2O_5$ ratio is larger than 0 and not more than 3. Further, the phosphoric acid in the step (b) is not necessarily required to be used in the form of a free acid and may be used in the form of a salt with the substance (A) and/or, if used, the substance (B). When the phosphoric acid is used in such salt form, the use of the substance (A) and/or the substance (B) may be omitted.

The substance (A) is one which can react with phosphoric acid to give a water-soluble salt, which is then hydrolyzed and/or reacted with the iron substrate to form a volatile base. Specific examples of the substance (A) are ammonia, ammonium hydroxide, hydroxylamine, tetraalkylammonium hydroxide of which the alkyl group has not more than 2 carbon atoms (e.g. tetramethylammonium hydroxide, tetraethylammonium hydroxide), alkylamine of which the alkyl group has not more than 2 carbon atoms (e.g. methylamine, ethylamine), dialkylamine of which the alkyl group has not more than 2 carbon atoms (e.g. dimethylamine, diethylamine), trialkylamine of which the alkyl group has not more than 2 carbon atoms (e.g. trimethylamine, triethylamine), etc. Specific examples of the phosphate of the substance (A) are ammonium phosphate, ammonium dihydrogen phosphate, diammonium hydrogen phosphate, etc.

The substance (B) is to be the one which can react with phosphoric acid to give a water-soluble salt, which is then hydrolyzed and/or reacted with the iron substrate to form a non-volatile base is formed. Specific examples of the subtance (B) are alkali metal (e.g. potassium, sodium), alkali metal oxide (e.g. sodium oxide, potassium oxide, sodium peroxide), alkali metal hydroxide (e.g. sodium hydroxide, potassium hydroxide), etc. Specific examples of the phosphate of the substance (B) are sodium phosphate, sodium dihydrogen phosphate, disodium hydrogen phosphate, sodium metaphosphate, sodium pyrophosphate, etc.

In place of the substance (A) and/or the substance (B), there may be used a substance which has both the properties required for (A) and (B). Specific examples of such substance are ammonium sodium hydrogen phosphate, ammonium potassium hydrogen phosphate, etc.

The total ion concentration in the after treatment solution is to be from 0.2 to 8 weight/volume percent, preferably from 0.2 to 5 weight/volume percent. When the concentration is less than 0.2 weight/volume percent, a sufficient rust proof effect is not obtained. When the concentration is over 8 weight/volume percent, the amount of the electrolyte remaining on the surface of the iron substrate is much increased irrespective of the kind of the electrolyte and deteriorates the corrosion resistance and the adhesiveness of the coating film later formed with a paint composition.

When the substance (B) is used, the concentration of the cation from the same is required to be not more than 0.5 weight/volume percent, preferably not more than 0.3 weight/volume percent. In case of the concentration being over 0.5 weight/volume percent, the amount of the non-volatile base formed by the hydrolysis of the water-soluble salt produced from phosphoric acid and the substance (B) and/or the reaction of such water-soluble salt with the iron substrate is increased, and the pH at the surface of the iron substrate is elevated whereby the corrosion resistance and the adhesiveness of the coating film are deteriorated. In case of the substance (A) being used, the same hydrolysis and/or reaction as above proceed but, since the resulting base is volatile, it is released from the reaction system into the air and therefore the concentration of the base does not become increased.

The pH of the after treatment solution should be from 1 to 9, preferably from 3 to 8. When the pH is lower than 3, a tendency of producing white powdery substances or rusts on the surface of the iron substrate is seen. Particularly when the pH is lower than 1, such tendency becomes more remarkable, and a seriously unfavorable influence on the corrosion resistance and the adhesiveness of the coating film appears. When the pH is higher than 8, the remaining of an alkaline substance on the surface of the iron substrate is seen. Particularly when the pH is over 9, such remaining becomes remarkable so as to afford an unfavorable influence on the corrosion resistance and the adhesiveness of the coating film.

In addition to phosphoric acid with the substance (A) and/or the substance (B) as the essential components, the after treatment solution preferably includes a stannous compound (e.g. stannous oxide, stannous chloride, stannous sulfate) in a concentration of 0.01 to 0.1 weight/volume %. The stannous compound is effective in suppressing the production of the white powdery substance on the surface of the iron substrate.

Besides, the after treatment solution may contain any conventional rust preventive agent or oxidizing agent in an appropriate concentration which does not substantially reduce the effect of the after treatment solution as above.

Treatment with the said treating solutions in the steps (a) and (b) may be carried out in a per se conventional procedure such as spraying or dipping, usually at a temperature of room temperature to 80°C under a pressure of 0.3 to 20 kg/cm² for a period of 1 to 120 minutes.

After the treatment in the step (b), the iron substrate may be subjected to drying without previous water rinsing. The drying may be effected in any per se conventional procedure such as air blowing but natural drying is industrially advantageous particularly when the iron substrate is to be treated is of a great structure.

It is a great advantage of this invention that the chemical treatment of the surface of an iron substrate, particularly of a large iron structure for derusting, rust preventing and surface conditioning for painting is accomplished in fewer steps and in a smaller area space without water rinsing. It is also an advantage that an appropriately conditioned surface can be formed on an iron substrate without production of rusts or unfavorable remaining substances, even when the treatment is carried out over a long period of time. A further advantage is that, since a very broad scope of the total ion concentration is utilizable for the after treatment solution, the continuous and repeated use of such treating solution, even when contaminated with a considerable amount of the pretreatment solution is possible without disposing and making up. In addition, the concentration of the effective substances in the after treatment solution can be made high so as to increase the rust proof property. Thus, the chemical treatment of the invention is very economical and practical.

Still, the pretreatment solution, which has been repeatedly used and therefore contains a high concentration of iron ion, may be subjected to treatment with an ion exchange resin to eliminaate iron ion therefrom.

Practical and presently preferred embodiments of the present invention are illustrated in the following Examples, wherein percent is weight by volume percent unless otherwise indicated.

EXAMPLE 1

A. Preparation of the treating solution to be used in the step (a) (i.e. the pretreatment solution):

A-1

Aqueous solution prepared by dissolving 75 % orthophosphoric acid in water to make a concentration of 12 % of orthophosphoric acid.

A-2

Aqueous solution prepared by dissolving 75 % orthophosphoric acid and an acid pickling inhibitor "Rodin No. 57" (the polycondensate of o-toluidine and thiourea; manufactured by Nippon Paint Co., Ltd.) in water to make a concentration of 12 % of orthophosphoric acid and a concentration of 0.05 % of the acid pickling inhibitor.

A-3

Aqueous solution prepared by dissolving 75 % orthophosphoric acid and stannous chloride dihydrate in water to make a concentration of 12 % of orthophosphoric acid and a concentration of 0.05 % of stannous chloride.

A-4

Aqueous solution prepared by dissolving 75 % of orthophosphoric acid, the acid pickling inhibitor as in A-2 and stannous chloride dihydrate in water to make a concentration of 12 % of orthophosphoric acid, a concentration of 0.005 % of the acid pickling inhibitor and a concentration of 0.05 % of stannous chloride.

B. Preparation of the treating solution to be used in the step (b) (i.e. the after treatment solution):

B-1

Aqueous solution prepared by dissolving ammonium dihydrogen phosphate and disodium hydrogen phosphate dodecahydrate in water to make a concentration of 0.432 % of ammonium dihydrogen phosphate and a concentration of 0.019 % of disodium hydrogen phosphate (pH, 5.0 to 5.5; total ion concentration, 0.44 %).

B-2

Aqueous solution prepared by dissolving ammonium dihydrogen phosphate, disodium hydrogen phosphate dodecahydrate and stannous chloride dihydrate in water to make a concentration of 0.35 % of ammonium dihydrogen phosphate, a concentration of 0.02 % of disodium hydrogen phosphate and a concentration of 0.018 % of stannous chloride (pH, 5.0 to 5.5; total ion concentration, 0.37 %).

B-3

Aqueous solution prepared by dissolving ammonium dihydrogen phosphate, disodium hydrogen phosphate dodecahydrate and sodium tripolyphosphate in water to make a concentration of 0.46 % of ammonium dihydrogen phosphate, a concentration of 0.02 % of disodium hydrogen phosphate and a concentration of 0.02 % of sodium tripolyphosphate (pH, 5.3 to 5.8; total ion concentration, 0.49 %).

B-4

Aqueous solution prepared by dissolving sodium phosphate and sodium nitrite in water to make a concentration of 2.3 % of sodium phosphate and a concentration of 1.7 %.

B-5

Aqueous solution prepared by dissolving dicyclohexylamine oleate in water to make a concentration of 4 % of dicyclohexylamine oleate.

C. Chemical treatment:

The test pieces (shot-blasted hot-rolled steel plate) were left in the open air for ten days and then subjected to chemical treatment as shown in Table 1.

Table 1

| Test No. | Steps and Treating solutions | | |
|---|---|---|---|
| 1 | Treatment with A-1 → | Treatment with B-1 → | Natural drying |
| 2 | Treatment with A-1 → | Treatment with B-2 → | Natural drying |
| 3 | Treatment with A-1 → | Treatment with B-3 → | Natural drying |
| 4 | Treatment with A-2 → | Treatment with B-1 → | Natural drying |
| 5 | Treatment with A-2 → | Treatment with B-2 → | Natural drying |
| 6 | Treatment with A-2 → | Treatment with B-3 → | Natural drying |
| 7 | Treatment with A-3 → | Treatment with B-1 → | Natural drying |
| 8 | Treatment with A-3 → | Treatment with B-2 → | Natural drying |
| 9 | Treatment with A-4 → | Treatment with B-1 → | Natural drying |
| 10 | Treatment with A-4 → | Treatment with B-2 → | Natural drying |

Table 1-continued

| Test No. | Steps and Treating solutions | | | |
|---|---|---|---|---|
| 11 | Treatment with A-1 → | | | Natural drying |
| 12 | Treatment with A-1 → | Rinsing with water → | | Natural drying |
| 13 | Treatment with A-1 → | Rinsing with water → | Treatment with B-4 → | Natural drying |
| 14 | Treatment with A-1 → | Rinsing with water → | Treatment with B-5 → | Natural drying |
| 15 | Treatment with A-1 → | Treatment with B-4 → | | Natural drying |
| 16 | Treatment with A-1 → | Treatment with B-5 → | | Natural drying |

After the treatments, the test pieces were subjected to observation regarding rust formation and white powder formation. The results of the observations were indicated by the following marks: no rusting, ◎; less than 10 % rusting, ○; 10 to 50 % rusting, Δ; more than 50 % rusting, x. No white powder ◎; less than 3 g/m² white powder, o; 3 to 20 g/m² white powder; Δ; more than 20 g/m², x.

Then, a tar epoxy paint "Epotar" (manufactured by Nippon Paint Co., Ltd.) or an inorganic zinc paint "Nippezin No. 1000MHB" (manufactured by Nippon Paint Co., Ltd.) was applied thereon to form a coating film of 100 ± 10 μ or of 50 ± 10 μ. After natural drying for 7 days, the adhesiveness and the corrosion resistance were examined.

The adhesiveness was examined by the aid of an adherogaugemeter "Tonite 504 E" (manufactured by Motofuji Co., Ltd.), and the evaluation was indicated by the following marks: higher than 40 kg/cm², ◎; 30 to 40 kg/cm², o; 20 to 30 (but not 30) kg/cm², Δ; lower than 20 kg/cm², x.

The evaluation of the corrosion resistance was made on the test pieces after immersing in 5 % aqueous sodium chloride solution at 40°C for 60 days. In the case of the test pieces wherein the tar epoxy paint is applied, the ASTM blister standard was adopted and the following marks were used: less than 6M, ◎; 6M to 4MD (but not 4MD), o; 4MD to 2D, Δ; more than 2D, x. In case of the ones applied the inorganic zinc paint, the percentage of rustings was indicated by the following marks: less than 5 %, ◎; 5 to 25 (but not 25) %, o; 25 to 50 %, Δ, more than 50 %, x.

The results are shown in Table 2.

Table 2

| Test No. | Observation on surface after chemical treatment | | Tar epoxy paint coating | | Inorganic zinc paint coating | |
|---|---|---|---|---|---|---|
| | Rusting | White powder production | Adhesiveness | Corrosion resistance | Adhesiveness | Corrosion resistance |
| 1 | ◎ | Δ | o | o | Δ | o |
| 2 | ◎ | o | ◎ | ◎ | ◎ | ◎ |
| 3 | ◎ | Δ | o | o | Δ | o |
| 4 | ◎ | o | ◎ | ◎ | ◎ | ◎ |
| 5 | ◎ | ◎ | ◎ | ◎ | ◎ | ◎ |
| 6 | ◎ | o | ◎ | ◎ | ◎ | ◎ |
| 7 | ◎ | o | ◎ | ◎ | ◎ | ◎ |
| 8 | ◎ | ◎ | ◎ | ◎ | ◎ | ◎ |
| 9 | ◎ | ◎ | ◎ | ◎ | ◎ | ◎ |
| 10 | ◎ | ◎ | ◎ | ◎ | ◎ | ◎ |
| 11 | ◎ | x | Δ | Δ | Δ | x |
| 12 | x | Δ | Δ | Δ | x | x |
| 13 | x | Δ | Δ | x | x | x |
| 14 | x | Δ | Δ | Δ | x | x |
| 15 | o | o | x | x | x | x |
| 16 | o | o | x | x | x | x |

From the results as shown in Table 2, it is understood that the treatments in Test Nos. 1 to 10 (according to the method of this invention) afford a good influence on the adhesiveness and the corrosion resistance of the coating film formed by a paint applied later. In the treatments in Test Nos. 11 to 16 (according to a conventional method), the adhesiveness and the corrosion resistance of the coating film are inferior. It is also apparent from the said results that the addition of an acid pickling inhibitor to the pretreatnent solution is effective. It is further apparent that the presence of a stannous compound with or without an acid pickling inhibitor in the pretreatment solution is effective. Moreover, it may be understood that the incorporation of a stannous compound into the after treatment solution is effective.

EXAMPLE 2

Adopting the substantially same conditions as in Example 1, a test piece was treated with the pretreatment solution A-2 and then treated with the after treatment solution B-1 and B-4 contaminated with the pretreatment solution A-2. The same tar epoxy paint or inorganic zinc paint as in Example 1 was applied on the thus treated test piece.

The results of the observation are shown in Table 3, wherein the evaluation was indicated as in Example 1.

Table 3

| Test No. | Original after treatment solution | pH of after treatment solution | Surface condition | | Tar epoxy paint coating | | Inorganic zinc coating | |
|---|---|---|---|---|---|---|---|---|
| | | | Rusting | White powder production | Adhesiveness | Corrosion resistance | Adhesiveness | Corrosion resistance |
| 17 | B-1 | 1.0 | Δ | x | o | o | Δ | o |
| 18 | B-1 | 3.0 | o | Δ | ◎ | ◎ | o | o |
| 19 | B-1 | 5.4 | ◎ | o | ◎ | ◎ | o | ◎ |
| 20 | B-4 | 5.0 | o | x | x | x | x | x |

As understood from the results in Test Nos. 17 to 19 (according to the method of this invention), the contamination of the pretreatment solution into the after treatment solution does not substantially deteriorate the abilities of the latter for neutralization, rust prevention and surface conditioning insofar as the pH is at 6.0 to 3.0. Even in case of pH 1 to 3, any marked deterioration of the surface conditioning ability is not seen. In Test No. 20 (according to a conventional method), it is shown that the production of white powder is remarkable so that a favorable surface conditioning cannot be expected.

EXAMPLE 3

(A) Preparation of the pretreatment solution:

A-5

Aqueous solution prepared by dissolving 75 % orthophosphoric acid in water to make a concentration of 12 % of orthophosphoric acid.

A-6

Aqueous solution prepared by dissolving 75 % orthophosphoric acid and the acid pickling inhibitor as in A-2 in water to make a concentration of 12 % of orthophosphoric acid and a concentration of 0.05 % of the acid pickling inhibitor.

B. Preparation of the after treatment solution:

B-6

Aqueous solution prepared by dissolving ammonium dihydrogen phosphate and disodium hydrogen phosphate dodecahydrate in water to make a concentration of 0.432 % of ammonium dihydrogen phosphate and a concentration of 0.019 % of disodium hydrogen phosphate (pH, 5.0 to 5.5; total ion concentration, 0.440 %).

C. Chemical treatment:

The test pieces as in Example 1 were left in the open air for ten days and then subjected to chemical treatment as shown in Table 4.

Table 4

| Test No. | Steps and Treating solutions | | | | |
|---|---|---|---|---|---|
| 21 | Treatment with A-5 → | Rinsing with water → | Treatment with B-6 → | Rinsing with water → | Natural drying |
| 22 | Treatment with A-5 → | Rinsing with water → | Treatment with B-6 → | | Natural drying |
| 23 | Treatment with A-5 → | | Treatment with B-6 → | | Natural drying |

Table 4-continued

| Test No. | Steps and Treating solutions | | | | |
|---|---|---|---|---|---|
| 24 | Treatment with A-6 → | Rinsing with water → | Treatment with B-6 → | Rinsing with water → | Natural drying |
| 25 | Treatment with A-6 → | Rinsing with water → | Treatment with B-6 → | | Natural drying |
| 26 | Treatment with A-6 → | | Treatment with B-6 → | | Natural drying |

Note: The treatments were effected under the following conditions:
(a) Pretreatment: temperature, 50 ± 5°C; time, 30 minutes; spray pressure, 1 kg/cm².
(b) Water rinsing: temperature, room temperature; time, 10 minutes; spray pressure, 1 kg/cm².
(c) After treatment: temperature, 60 ± 5°C; time, 10 minutes; spray pressure, 1 kg/cm².
The interval time between one step and the subsequent step, 15 minutes.

After the treatments, the test pieces were subjected to observation regarding rust formation and white powder formation. The results of the observations were indicated by the marks having the same meanings as in Example 1.

Then, the tar epoxy paint or the inorganic zinc paint as in Example 1 was applied thereon to form a coating film of 100 ± 10 μ or of 50 ± 10 μ. After natural drying for 2 weeks, the adhesiveness and the corrosion resistance were examined.

The adhesiveness was examined by the aid of an adhesion tester "Adhesion Tester Model 106" (manufactured by Elco Meter Co., Ltd.), and the evaluation was indicated by the following marks: higher than 30 kg/cm², ◎;20 to 30 kg/cm²,o; 10 to 20 (but not 20) kg/cm², Δ; lower than 10 kg/cm², x.

The evaluation of the corrosion resistance was made on the test pieces after immersing in 3 % aqueous sodium chloride solution at room temperature for 3 months while blowing air therein. In the case of the test pieces, wherein the tar epoxy paint, is applied the ASTM blister standard was adopted and the following marks were used: 8 to 6F, ◎; 4 to 2F, 8 to 4M,o; 2M, 8 to 2MD, Δ; 8 to 4D, x; less than 2D, xx. In the case of the test pieces, wherein the inorganic zinc paint is applied, the percentage of rustings was indicated by the following marks: less than 1 %, ◎; 1 to 5 (but not 5) %, o; 5 to 25 (but not 25) %, Δ; 25 to 50 %, x.

The results are shown in Table 5.

Table 5

| Test No. | Observation on surface after chemical treatment | | Tar epoxy paint coating | | Inorganic zinc paint coating | |
|---|---|---|---|---|---|---|
| | Rusting | White powder production | Adhesiveness | Corrosion resistance | Adhesiveness | Corrosion resistance |
| 21 | x | Δ | Δ | Δ | x | xx |
| 22 | x | Δ | Δ | Δ | x | xx |
| 23 | ◎ | Δ | O | O | Δ | O |
| 24 | x | O | Δ | Δ | x | x |
| 25 | x | O | Δ | Δ | x | x |
| 26 | ◎ | O | ◎ | ◎ | O | ◎ |

From the results as shown in Table 5, it is understood that the presence of the water rinsing step results in the increased production of rustings and the deterioration of the corrosion resistance and the adhesiveness of the coating film. When the pretreatment solution does contain any acid pickling inhibitor, the production of white powder is remarkable and the corrosion resistance and the adhesiveness of the coating film are inferior. In the case of the water rinsing step being omitted and the pretreatment solution containing an acid pickling inhibitor, the surface condition and the corrosion resistance and the adhesiveness of the coating film are very good.

EXAMPLE 4

A. Preparation of the pretreatment solution:

The pretreatment solution A-6 in Example 3 was prepared and used.

B. Preparation of the after treatment solution:

The after treatment solutions B-7 to B-22 having the compositions, ion concentrations and pH values as shown in Table 6 were prepared.

Table 6

| After treatment solution | Composition | | | | | Ion concentration | | pH |
|---|---|---|---|---|---|---|---|---|
| | Form of phosphates | Phosphoric acid (%) | Primary phosphate (%) | Secondary phosphate (%) | Tertiary phosphate (%) | Sodium ion (%) | Total ion (%) | |
| B-7 | | 0 | 0 | 0.3 | 0.2 | 0 | 0.5 | 10.5 |
| B-8 | | 0 | 0 | 0.5 | 0 | 0 | 0.5 | 7.2 |
| B-9 | Ammonium | 0 | 0 | 4.0 | 0 | 0 | 4.0 | 7.8 |
| B-10 | salt | 0 | 0.45 | 0.05 | 0 | 0 | 0.5 | 6.0 |
| B-11 | | 0 | 3.6 | 0.4 | 0 | 0 | 4.0 | 5.4 |
| B-12 | | 0.1 | 0.4 | 0 | 0 | 0 | 0.5 | 3.4 |
| B-13 | | 0.4 | 3.6 | 0 | 0 | 0 | 4.0 | 3.0 |
| B-14 | | 3.6 | 0.4 | 0 | 0 | 0 | 4.0 | 0.8 |
| B-15 | | 0 | 0 | 0.3 | 0.2 | 0.2 | 0.5 | 11.3 |
| B-16 | | 0 | 0 | 0.5 | 0 | 0.2 | 0.5 | 8.0 |
| B-17 | Sodium | 0 | 0 | 4.0 | 0 | 1.3 | 4.0 | 8.5 |
| B-18 | salt | 0 | 0.45 | 0.05 | 0 | 0.1 | 0.5 | 6.0 |
| B-19 | | 0 | 3.6 | 0.4 | 0 | 0.8 | 4.0 | 5.4 |
| B-20 | | 0.1 | 0.4 | 0 | 0 | 0.1 | 0.5 | 3.3 |
| B-21 | | 0.4 | 3.6 | 0 | 0 | 0.7 | 4.0 | 3.0 |
| B-22 | | 3.6 | 0.4 | 0 | 0 | 0.1 | 4.0 | 0.8 |

C. Chemical treatment:

The test pieces as in Example 1 were left in the open air for ten days and then subjected to chemical treatment, i.e. pretreatment, after treatment and natural drying in order under the following conditions:

a. Pretreatment: temperature, 50° ± 5°C; time, 30 minutes; spray pressure, 1 kg/cm².

b. Water rinsing: temperature, room temperature; time, 10 minutes; spray pressure, 1 kg/cm².

c. After treatment: temperature, 60° ± 5°C; time, 10 minutes; spray pressure, 1 kg/cm².

The interval time between one step and the subsequent step, 15 minutes.

After the treatments, the test pieces were subjected to pH measurements and the remaining salt concentration on the surface. The pH measurement was made by determining the pH of the water dropped on the surface with a pH test paper. The remaining salt concentration was determined by immersing the test piece of 10 cm × 15 cm in size into 200 ml of pure water, measuring the electro-conductivity of the immersed water and deducing the electro-conductivity value of pure water from the measured value.

Then, the tar epoxy paint as in Example 1 was applied thereon to form a coating film of 100 ± 10 μ. The adhesiveness and the corrosion resistace of the coating film were examined as in Example 3.

The results are shown in Table 7.

Table 7

| After treatment solution | Surface condition | | Tar epoxy paint coating film | |
|---|---|---|---|---|
| | pH | Remaining salt concentration (μV/cm) | Corrosion resistance | Adhesiveness |
| B-7 | 6.6 | 7.0 | Δ | Δ |
| B-8 | 6.2 | 6.3 | ◎ | ◎ |
| B-9 | 6.0–6.4 | 10.2 | ◎ | ◎ |
| B-10 | 6.0 | 2.0 | ◎ | ◎ |
| B-11 | 5.8 | 4.1 | ◎ | ◎ |
| B-12 | 5.8 | 2.5 | ◎ | ◎ |
| B-13 | 6.0 | 3.8 | ◎ | ◎ |
| B-14 | 4.4 | 45.0 | Δ | Δ |
| B-15 | 9.8 | 14.0 | x | Δ |
| B-16 | 7.4–7.6 | 12.1 | o | ◎ |
| B-17 | 8.6–9.2 | 107.5 | Δ | o |
| B-18 | 5.6 | 3.8 | ◎ | ◎ |
| B-19 | 8.4–8.8 | 62.9 | Δ | o |
| B-20 | 5.8 | 7.0 | ◎ | ◎ |
| B-21 | 8.4–8.8 | 38.2 | Δ | o |
| B-22 | 4.6 | 48.2 | Δ | Δ |

As understood from the results as shown in Table 7, the corrosive resistance and the adhesiveness of the coating film are deteriorated when the pH of the after treatment solutions, irrespective of using sodium salts or ammonium salts is not within a range of 1 to 9. When the pH is within a range of 1 to 9, a higher concentration of sodium ion in the after treatment solution results in a higher pH and a higher concentration of the remaining salt at the surface of the test piece with the deterioration of the corrosion resistance of the coating film. In the case of using ammonium salts, the pH at the surface is almost constant in a slightly acidic range, irrespective of the total ion concentration and the pH of the after treatment solution, the remaining salt concentration is low and the corrosion resistance of the coating film is good.

EXAMPLE 5

A. Preparation of the pretreatment solution:

The pretreatment solution A-6 in Example 3 was prepared and used.

B. Preparation of the after treatment solution:

The after treatment solutions B-10 and B-18 in Example 4 were prepared and each admixed with the said pretretment solution A-6 (and a phosphate) to make the compositions, the ion concentrations and the pH values as shown in Table 8.

Table 8

| After treatment solution | Composition: Original after treatment solution | Composition: Amount of pretreatment solution contaminated (%) | Composition: Phosphate added | Ion concentraton: Sodium ion (%) | Ion concentraton: Total ion (%) | pH |
|---|---|---|---|---|---|---|
| B-23 | | 0 | None | 0 | 0.1 | |
| B-24 | | 0 | | 0 | 0.5 | |
| B-25 | B-10 | 2.5 | Diammonium | 0 | 1.1 | 5–6 |
| B-26 | | 15 | hydrogen | 0 | 4.0 | |
| B-27 | | 25 | phosphate | 0 | 6.2 | |
| B-28 | | 40 | | 0 | 9.0 | |
| B-29 | | 0 | None | 0.02 | 0.1 | |
| B-30 | | 0 | | 0.1 | 0.5 | |
| B-31 | B-18 | 2.5 | Disodium | 0.2 | 1.1 | 5–6 |
| B-32 | | 6 | Hydrogen | 0.4 | 1.9 | |
| B-33 | | 15 | phosphate | 0.8 | 4.0 | |
| B-34 | | 25 | | 1.2 | 6.2 | |

Note:
The after treatment solutions B-23 and B-29 were used as 5 fold dilutions of the after treatment solutions B-10 and B-18 with water, respectively.

C. Chemical treatment:

The test pieces as in Example 1 were left in the open air for ten days and then subjected to chemical treatment, i.e. pretreatment, after treatment and natural drying in order under the following conditions:

a. Pretreatment: temperature, 50° ± 5°C; time, 30 minutes; spray pressure, 1 kg/cm$^2$.
b. Water rinsing: temperature, room temperature; time, 10 minutes; spray pressure, 1 kg/cm$^2$.
c. After treatment: temperature, 60° ± 5°C; time, 10 minutes; spray pressure, 1 kg/cm$^2$.

The interval time between one step and the subsequent step, 15 minutes.

After the treatments, the test pieces were subjected to pH measurements and the remaining salt concentration on the surface as in Example 4.

Then, the tar epoxy paint as in Example 1 or an oily rust preventing paint "LZ primer" (manufactured by Nippon Paint C0., Ltd.) was applied on the treated surface of the test piece to form a coating film of 60 ± 5 $\mu$ in thickness. The adhesiveness and the corrosion resistance of the coating film were examined as in Example 3. In the case of using the oily rust preventing paint, the test piece was immersed in an aqueous sodium chloride solution for 1.5 months, and the corrosion resistance was evaluated in the same manner as in using the tar epoxy paint.

The results are shown in Table 9.

Table 9

| After treatment solution | Surface condition: pH | Surface condition: Remaining salt concentration ($\mu$V/cm) | Tar epoxy paint coating: Corrosion resistance | Tar epoxy paint coating: Adhesiveness | Oily rust preventing paint coating: Corrosion resistance | Oily rust preventing paint coating: Adhesiveness |
|---|---|---|---|---|---|---|
| B-23 | 5.6 | 1.0 | Δ | Δ | Δ | Δ |
| B-24 | 6.8 | 2.0 | ◎ | ◎ | ◎ | ◎ |
| B-25 | 5.8 | 3.2 | ◎ | ◎ | ◎ | ◎ |
| B-26 | 5.8 | 4.1 | ◎ | ◎ | ◎ | ◎ |
| B-27 | 6.2 | 9.8 | ◎ | ◎ | o | ◎ |
| B-28 | 6.4 | 25.6 | Δ | o | Δ | o |
| B-29 | 5.6 | 1.5 | Δ | Δ | Δ | Δ |
| B-30 | 5.6 | 3.8 | ◎ | ◎ | ◎ | ◎ |
| B-31 | 6.0 | 10.5 | ◎ | ◎ | o | ◎ |
| B-32 | 7.4 | 22.8 | o | ◎ | Δ | o |
| B-33 | 8.8 | 62.9 | Δ | o | x | Δ |
| B-34 | 9.2 | 141.0 | x | Δ | x | Δ |

As understood from the results as shown in Table 9, the after treatment solution obtained by admixing the original after treatment solution B-10 or B-18 with a designed amount of the pretreatment solution A-6 and adjusting the pH to 5–6 causes the production of rustings and the deterioration of the corrosion resistance and the adhesiveness of the coating film when the total ion concentration is less than 0.2%. In the case of the total ion concentration being relatively low, i.e. 0.5 to 1.1%, the difference depending on the kind of the phosphate used for regulation of the pH is not materially seen. In the case of the total ion concentration being relatively large, i.e. 1.9 to 6.2%, a considerable difference is produced on the surface condition of the test piece and the corrosion resistance of the coating film. When a sodium salt is used for the after treatment solution, a total ion concentration higher than 1.5% deteriorates the corrosion resistance and, depending on the kind of the paint, even the adhesiveness. When an ammonium salt is used for the after treatment solution, no deterioration in the corrosion resistance and the adhesiveness of the coating film is seen up to a total ion concentration of 8%.

EXAMPLE 6

A. Preparation of the pretreatment solution:

The pretreatment solution A-6 in Example 1 was prepared and used.

B. Preparation of the after treatment solution:

The after treatment solutions B-35 to B-40 having the compositions, the total ion concentrations and the pH values as shown in Table 10 were prepared. The sodium ion and the ammonium ion were employed in the form of the primary phosphate salt.

Table 10

| After treatment solution | Composition: Sodium ion (%) | Composition: Ammonium ion (%) | Total ion concentration (%) | pH |
|---|---|---|---|---|
| B-35 | 0 | 1.00 | 6.4 | |
| B-36 | 0.10 | 0.90 | 6.3 | |
| B-37 | 0.20 | 0.80 | 6.1 | 4–4.5 |
| B-38 | 0.50 | 0.50 | 5.8 | |
| B-39 | 0.75 | 0.25 | 5.4 | |
| B-40 | 1.00 | 0 | 5.2 | |

C. Chemical treatment:

The test pieces as in Example 1 were left in the open air for ten days and then subjected to chemical treatment, i.e. pretreatment, after treatment and natural drying in order under the following conditions:

a. Pretreatment: temperature, 50° ± 5°C; time, 30 minutes; spray pressure, 1 kg/cm².
b. Water rinsing: temperature, room temperature; time, 10 minutes; spray pressure, 1 kg/cm².
c. After treatment: temperature, 60° ± 5°C; time, 10 minutes; spray pressure, 1 kg/cm².

The interval time between one step and the subsequent step, 15 minutes.

On the treated surface of the test pieces, the tar epoxy paint as in Example 1 or the oily rust preventing paint as in Example 5 was applied to make a coating film of 60 ± 5 μ in thickness. The adhesiveness and the corrosion resistance of the coating film were examined as in Example 3. In the case of using the oily rust preventing paint, the test pieces were immersed in an aqueous sodium chloride solution for 1.5 months, and the corrosion resistance was evaluated in the same manner as in using the tar epoxy resin paint.

The results are shown in Table 11.

Table 11

| After treatment solution | Corrosion resistance: Tar epoxy paint coating | Corrosion resistance: Oily rust preventing paint |
|---|---|---|
| B-35 | ◎ | o |
| B-36 | ◎ | o |
| B-37 | ◎ | o |
| B-38 | o | Δ |
| B-39 | Δ | x |
| B-40 | Δ | x |

From the results as shown in Table 11, it is understood that the use of the after treatment solution admixed with ammonium primary phosphate, and sodium primary phosphate results in the deterioration of the corrosion resistance of the coating film when the sodium ion concentration is higher than 0.5%. In case of the sodium ion concentration is lower, no material deterioration of the properties of the coating film is seen.

EXAMPLE 7

A. Preparation of the pretreatment solution:

The pretreatment solution A-6 in Example 3 was prepared and used.

B. Preparation of the after treatment solution: B-41

Aqueous solution prepared by dissolving ammonium dihydrogen phosphate, sodium pyrophosphate and sodium nitrite in water to make a concentration of 0.45% of ammonium dihydrogen phosphate, a concentration of 0.05% of sodium pyrophosphate and a concentration of 0.01% of sodium nitrite (pH 6.0; total ion concentration, 0.51%).

C. Chemical treatment:

The test pieces as in Example 1 were left in the open air for twenty days and then subjected to chemical treatment, i.e. pretreatment, after treatment and natural drying in order under the following conditions:

a. Pretreatment: temperature, 50° ± 5°C; time, 30 minutes; spray pressure, 1 kg/cm².
b. Water rinsing: temperature, room temperature; time, 10 minutes; spray pressure, 1 kg/cm².
c. After treatment: temperature, 60° ∓ 5°C; time, 10 minutes; spray pressure, 1 kg/cm².

The interval time between one step and the subsequent step, 15 minutes.

On the treated surface of the test pieces, the tar epoxy paint as in Example 1 or the oily rust preventing paint as in Example 5 was applied to make a coating film of 60 ± 5 μ in thickness. The adhesiveness and the corrosion resistance of the coating film were examined as in Example 3. In case of using the oily rust preventing paint, the test pieces were immersed in an aqueous sodium chloride solution for 1.5 months, and the corrosion resistance was evaluated in the same manner as in using the tar epoxy resin paint.

The results are shown in Table 12 in comparison with the results of the case where the after treatment solution B-10 was used in place of the after treatment solution B-41.

Table 12

| After treatment solution | Corrosion resistance: Tar epoxy paint coating | Corrosion resistance: Oily rust preventing paint coating | Adhesiveness: Tar epoxy paint coating | Adhesiveness: Oily rust preventing paint coating |
|---|---|---|---|---|
| B-10 | ◎ | ◎ | ◎ | ◎ |
| B-41 | ◎ | ◎ | ◎ | ◎ |

From the results as shown in Table 12, it is understood that the after treatment solution containing ammonium dihydrogen phosphate, a condensed phosphate (i.e. sodium pyrophosphate) and an inorganic rust preventing agent (i.e. sodium nitrite) is equally effective to the after treatment solution containing orthophosphates alone in affording a good corrosion resistance and a good adhesiveness on the coating film.

What is claimed is:

1. A method for the chemical treatment of the surface on an iron substrate to render the surface especially suitable for a subsequent painting step which consists essentially of the step of (a) treating the surface with an aqueous solution which consists essentially of phosphoric acid in a concentration of 0.5 to 80 weight/volume percent, followed by the step of (b) subjecting the surface without water rinsing to treatment with an aqueous solution consisting essentially of phosphoric acid and a substance (A) capable of reacting with the phosphoric acid to give a water-soluble salt, which salt is then hydrolyzed and/or reacted with the iron substrate to form a volatile base, said substance (A) being selected from the group consisting of ammonia, ammonium hydroxide, hydroxylamine, tetra-alkylammonium hydroxide of which the alkyl group has not more than 2 carbon atoms, an alkylamine of which the alkyl group has not more than 2 carbon atoms, a dialkylamine of which the alkyl group has not more than 2 carbon atoms, or a trialkylamine of which the alkyl group has not more than 2 carbon atoms or a substance (B) capable of reacting with the phosphoric acid to give a water-soluble salt, which salt is then hydrolyzed and/or reacted with the iron substrate to form a non-volatile base, said substance (B) being selected from the group consisting of an alkali metal, an alkali metal oxide or an alkali hydroxide, or mixtures of substances (A) and (B), the pH of the aqueous solution in step (b) being 1 to 9, the total ion concentration being 0.2 to 8 weight/volume percent and the concentration of the cation from the substance (B) being not more than 0.5 weight/volume percent, said aqueous solution of phosphoric acid and substance (A) or (B) being reused continuously for treating the surfaces of iron substrates in subsequent chemical treatment steps as defined above.

2. The method according to claim 1, wherein the phosphoric acid in the aqueous solution to be used in the step (a) is orthophosphoric acid, metaphosphoric acid or condensed phosphoric acid.

3. The method according to claim 1, wherein the concentration of the phosphoric acid in step (a) is 7 to 30 weight/volume percent.

4. The method according to claim 1, wherein the aqueous solution to be used in the step (a) further contains an acid pickling inhibitor in a concentration of 0.001 to 1 weight/volume % which shows an inhibitory efficiency of acid pickling of not less than 50%.

5. The method according to claim 4, wherein the acid pickling inhibitor is a member selected from the group consisting of a primary amine, a secondary amine, a tertiary amine, a quaternary ammonium compound, a thiourea compound and a stannous compound.

6. The method according to claim 1, wherein the total ion concentration of the aqueous solution to be used in the step (b) is 0.2 to 5 weight/volume percent.

7. The method according to claim 1, wherein the pH of the aqueous solution to be used in the step (b) is 3 to 8.

8. The method according to claim 1, wherein the phosphoric acid in the aqueous solution to be used in the step (b) is orthophosphoric acid, metaphosphoric acid or condensed phosphoric acid.

9. The method according to claim 1, wherein the concentration of the cation from the substance (B) is not more than 0.3 weight/volume percent.

10. The method according to claim 1, wherein ammonium phosphate, ammonium dihydrogen phosphate, diammonium hydrogen phosphate, ammonium hydrogen pyrophosphate, ammonium pyrophosphate, ammonium hydrogen tripolyphosphate, ammonium tripolyphosphate or hydroxylamine phosphate is used in place of the phosphoric acid and the substance (A).

11. The method according to claim 1, wherein alkali metal phosphate, alkali metal hydrogen pyrophosphate, alkali metal pyrophosphate, alkali metal hydrogen tripolyphosphate or alkali metal tripolyphosphate is used in place of the phosphate and the substance (B).

12. The method according to claim 1, wherein the aqueous solution to be used in the step (b) further contains a stannous compound in a concentration of 0.01 to 1 weight/volume %.

13. The method according to claim 12, wherein the stannous compound is stannous oxide, stannous hydroxide, stannous chloride or stannous sulfate.

14. The method according to claim 1, wherein the treatments in the steps (a) and (b) are carried out at a temperature of room temperature to 80°C.

* * * * *